US009408482B2

(12) United States Patent
Nesbitt

(10) Patent No.: US 9,408,482 B2
(45) Date of Patent: Aug. 9, 2016

(54) MODULAR PICTURE DISPLAY SYSTEM

(71) Applicant: Bonnie Northrop Nesbitt, Arlington, VA (US)

(72) Inventor: Bonnie Northrop Nesbitt, Arlington, VA (US)

( * ) Notice: Subject to any disclaimer, the term of this patent is extended or adjusted under 35 U.S.C. 154(b) by 0 days.

(21) Appl. No.: 14/830,595

(22) Filed: Aug. 19, 2015

(65) Prior Publication Data

US 2016/0073796 A1 Mar. 17, 2016

Related U.S. Application Data

(60) Provisional application No. 62/048,978, filed on Sep. 11, 2014.

(51) Int. Cl.

| | |
|---|---|
| ***A47G 1/06*** | (2006.01) |
| ***A47G 1/17*** | (2006.01) |
| ***G09F 7/04*** | (2006.01) |

(52) U.S. Cl.

CPC *A47G 1/065* (2013.01); *A47G 1/17* (2013.01); *G09F 7/04* (2013.01); *A47G 2001/0672* (2013.01)

(58) Field of Classification Search

CPC ..... A47G 1/17; A47G 1/20; A47G 1/168; A47G 1/16; A47G 2001/0672; F16B 47/003; G09F 1/10; B60R 1/06; B60R 1/0605; B60R 1/076

See application file for complete search history.

(56) References Cited

U.S. PATENT DOCUMENTS

| | | | | |
|---|---|---|---|---|
| 4,211,382 | A * | 7/1980 | Bonfils | A47G 1/168 248/467 |
| 4,530,482 | A * | 7/1985 | Berinson | A47G 1/1606 248/475.1 |
| 4,605,292 | A | 8/1986 | McIntosh | |
| 4,875,654 | A | 10/1989 | Chandonnet | |
| 5,039,047 | A | 8/1991 | Ptizo | |
| 5,269,083 | A | 12/1993 | Vampatella | |
| 5,921,405 | A | 7/1999 | Dumas | |
| 6,241,210 | B1 * | 6/2001 | Brindisi | A47G 1/1613 248/476 |
| 6,672,551 | B2 | 1/2004 | Rivellino | |
| 6,688,029 | B1 | 2/2004 | Dunn | |
| 7,934,330 | B2 | 5/2011 | Nicolaisen | |
| 8,042,308 | B2 * | 10/2011 | Sullivan | G09F 7/18 434/408 |
| 8,434,730 | B2 * | 5/2013 | Ahlstrom | A47G 1/168 248/206.5 |
| 2001/0038061 | A1 * | 11/2001 | Astell | A47G 1/1653 248/466 |
| 2002/0078612 | A1 | 6/2002 | Meacham et al. | |
| 2003/0221349 | A1 * | 12/2003 | Abe | G09F 7/10 40/711 |
| 2003/0233778 | A1 * | 12/2003 | Gross | A47G 1/06 40/711 |
| 2007/0210233 | A1 * | 9/2007 | Cave | A47G 1/168 248/467 |
| 2013/0160338 | A1 | 6/2013 | Forbis | |
| 2014/0061409 | A1 * | 3/2014 | Mayhew, Jr. | F16M 13/02 248/206.5 |
| 2014/0109450 | A1 | 4/2014 | Valois | |

* cited by examiner

*Primary Examiner* — Cassandra Davis

(74) *Attorney, Agent, or Firm* — Shifrin Patent Law; Dan Shifrin

(57) ABSTRACT

A modular picture display system is provided. The picture display system comprises a display frame comprising a back panel, a plurality of spaced apart magnets secured to a front-side of the back panel, a front panel having a central opening and edging surrounding the opening, the front panel configured to fit over the back panel, and a plurality of spaced apart ferrous plates secured to the backside of the front panel, whereby the backside of the front panel is securable to the front-side of the back panel through magnetic cooperation between the ferrous plates and the magnets.

8 Claims, 8 Drawing Sheets

MODULAR PICTURE DISPLAY SYSTEM

RELATED APPLICATION DATA

The present application claims the benefit of commonly-owned and co-pending U.S. Provisional Application Ser. No. 62/048,978, entitled MODULAR PICTURE DISPLAY SYSTEM, filed on Sep. 11, 2014, which application is incorporated herein by reference in its entirety.

TECHNICAL FIELD

The present invention relates generally to the display of pictures.

BACKGROUND ART

While there have been a number of picture frame devices which incorporate a magnet or magnets, they generally suffer from a rigidity of design, making them impractical when one wants to add or remove pictures or move them around.

SUMMARY OF THE INVENTION

A modular picture display system is provided, comprising a display frame comprising a back panel, a plurality of spaced apart magnets secured to a front-side of the back panel, a front panel having a central opening and edging surrounding the opening, the front panel configured to fit over the back panel, and a plurality of spaced apart ferrous plates secured to the backside of the front panel, whereby the backside of the front panel is securable to the front-side of the back panel through magnetic cooperation between the ferrous plates and the magnets. The display system further comprises.

A method for providing a picture display system is also provided, comprising providing a back panel, securing a plurality of spaced apart magnets to a front-side of the back panel, providing a front panel having a central opening and being configured to fit over the back panel, securing a plurality of spaced apart ferrous plates to a backside of the front panel, securing the backside of the front panel to the front-side of the back panel through magnetic cooperation between the ferrous plates and the magnets to form a display frame, and providing a ferrous strip, mountable on a vertical surface, on which one or more display frames are held in place in magnetic cooperation with the plurality of magnets.

DETAILED DESCRIPTION OF THE PREFERRED EMBODIMENT

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

Figure 1:
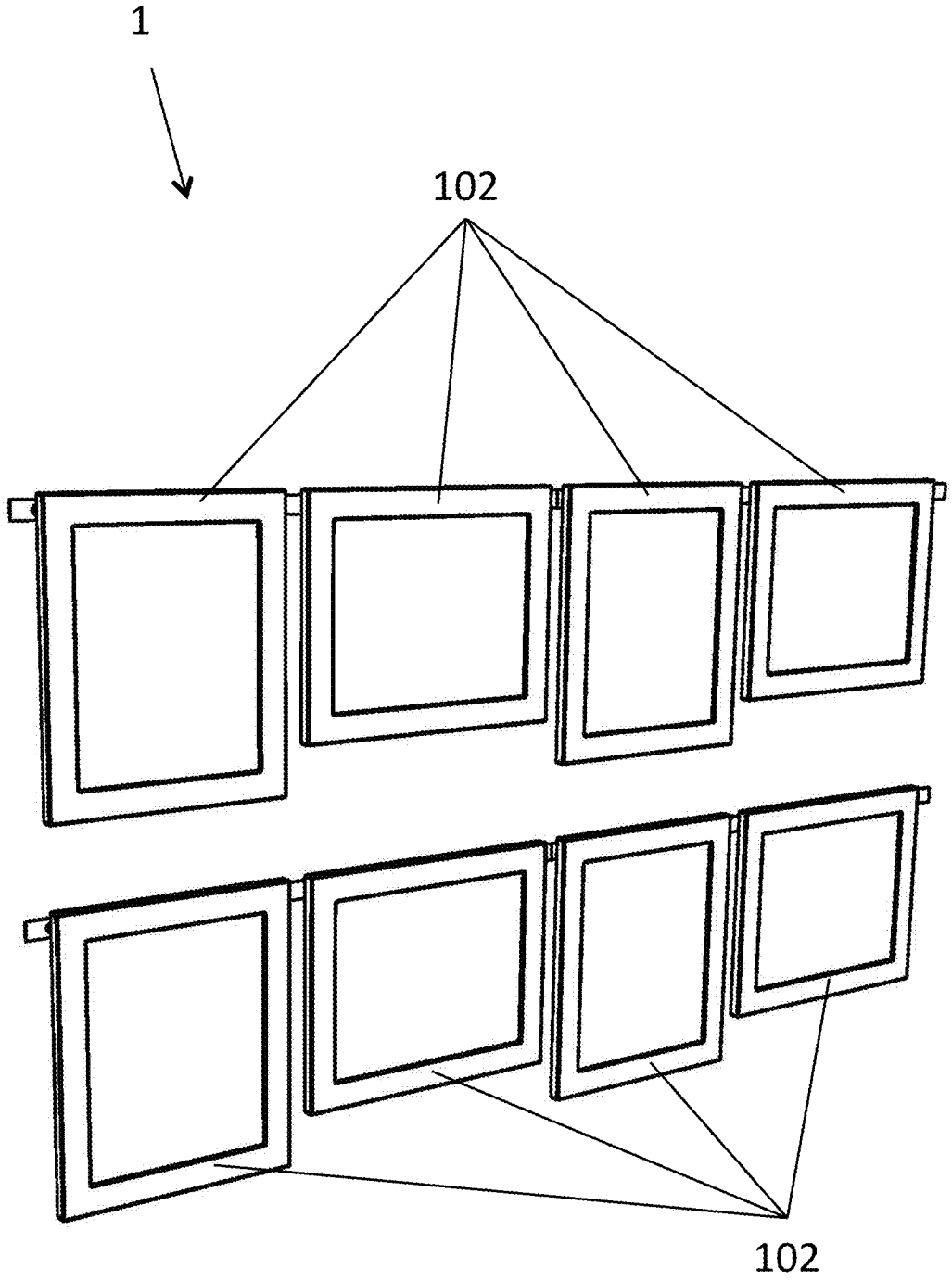
FIG. 1 illustrates one possible arrangement of picture frames with the modular picture display system of the present invention.

The present invention address the inflexibility of existing picture frames by providing a modular picture display system 1 in which framed pictures may be easily moved around, pictures may be easily added or removed from frames, and frames themselves may be easily changed to provide different colors and styles. FIG. 1 illustrates one possible arrangement of display frames 100 with the modular picture display system 1 of the present invention.

Figure 2A:
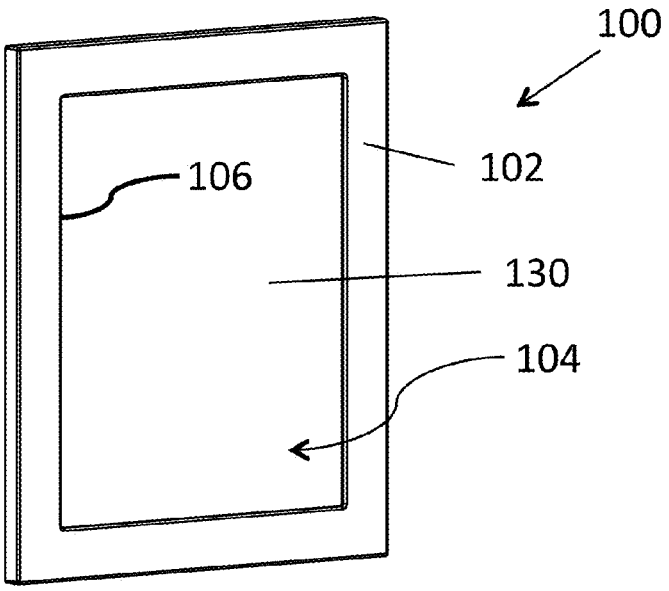
FIG. 2A illustrates a front view of an embodiment of a display frame that can be used with the modular picture display system of the present invention.
Figure 2B:
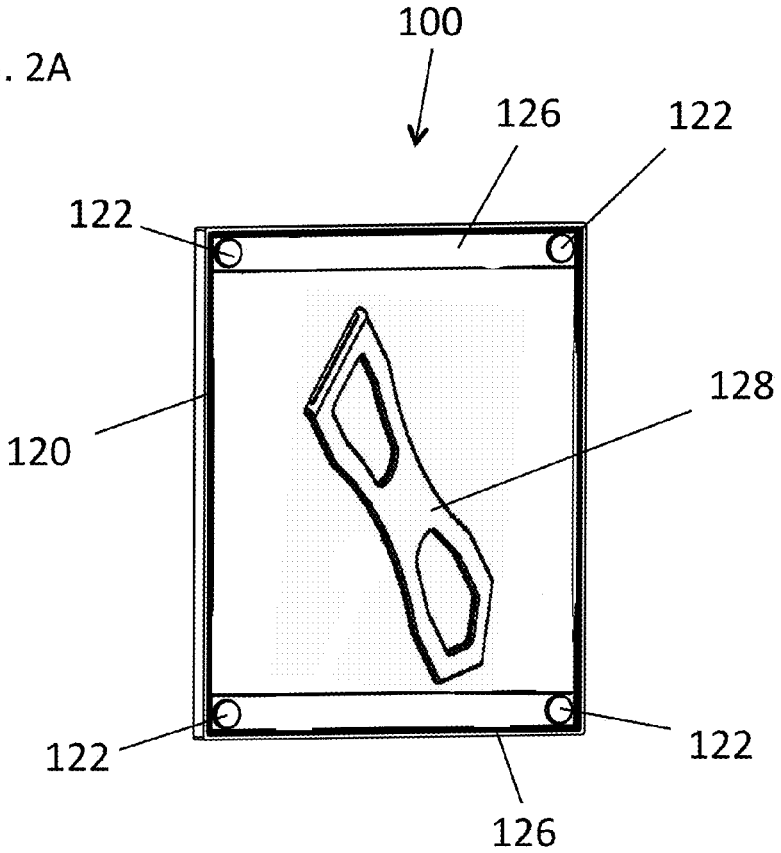
FIG. 2B illustrates a back view of the display frame of FIG. 2A.

FIG. 2A illustrates a front view of an embodiment of a frame 100 that can display pictures or other items as part of the modular picture display system 1 of the present invention while FIG. 2B illustrates a back view of the frame 100. The frame 100 includes a front panel 102 surrounding an opening 104, a transparent sheet 130 within the opening 104, and a back panel 120. In the FIGS., the picture frame 100, including the opening 104, are illustrated as being rectangular; however, they may be of any other shape. Edging 106 surrounds the perimeter of the opening 104 of the back of the front panel 102 to help hold a transparent sheet 130.

Figure 3:
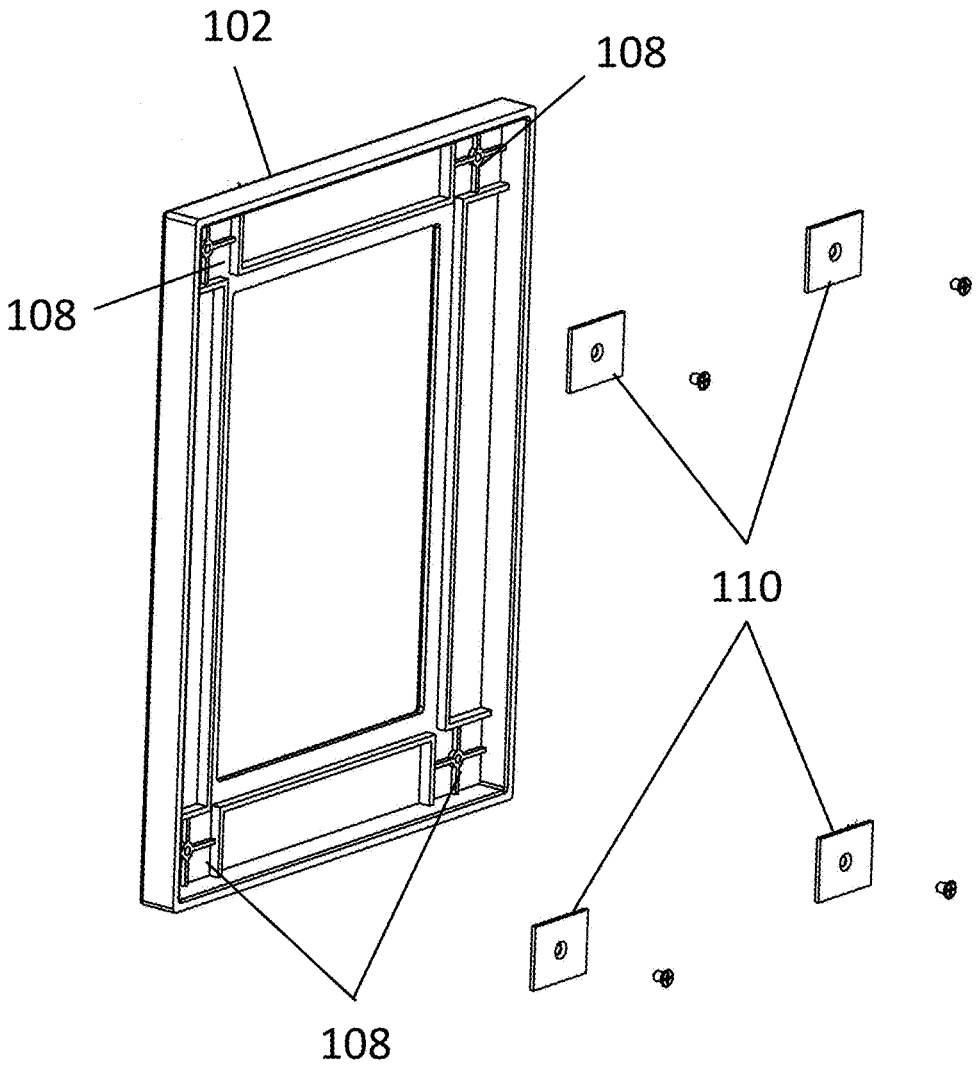
FIG. 3 illustrates a back view of front panel of the display frame of FIG. 2A.

FIG. 3 illustrates a back view of the front panel 102. Metal plates 110 are secured to the back of the front panel 102 in recesses 108, such as with screws, and, as will be described, hold the back panel 120 to the front panel 102.

Figure 4:
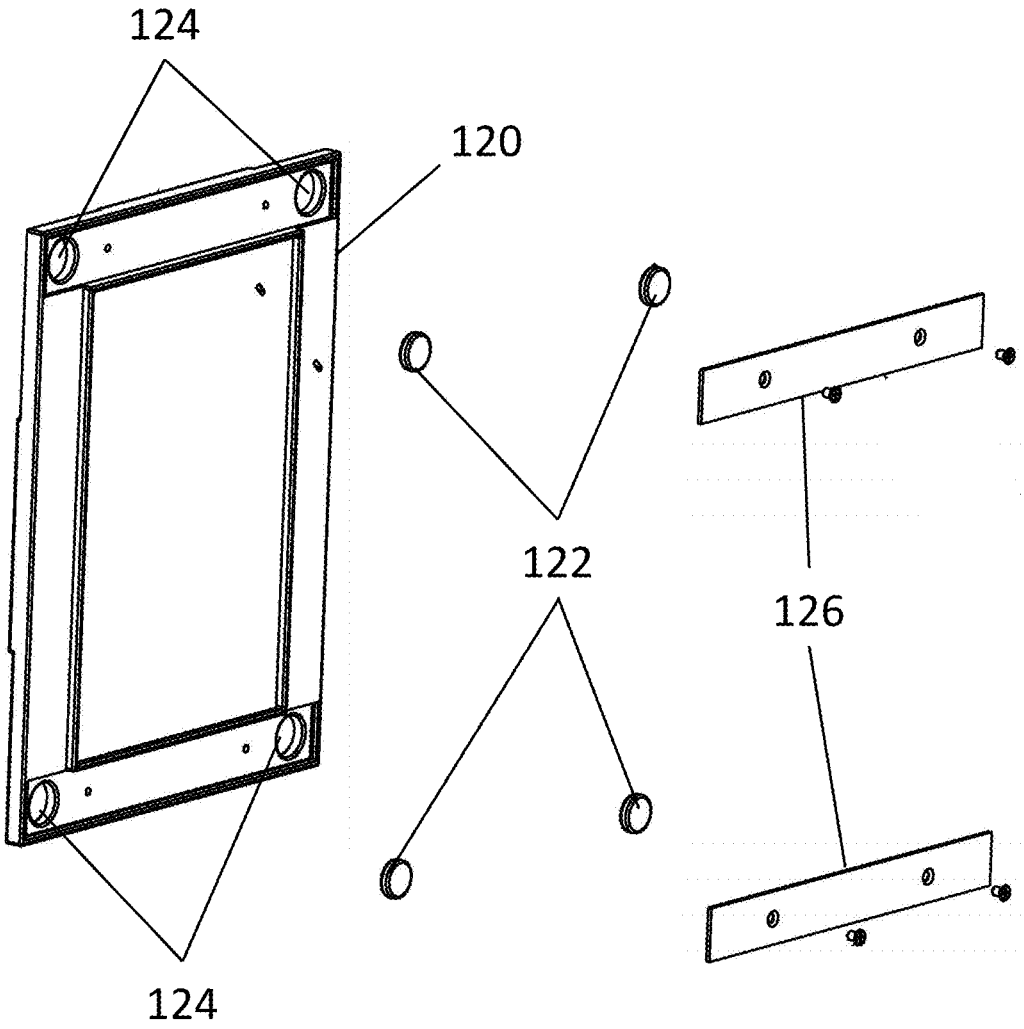
FIG. 4 illustrates a front view of the back panel of the display frame of FIG. 2A.

FIG. 4 illustrates a front view of the back panel 120. Magnets 122 may be secured to the back panel 120 in various arrangements, depending on the size and weight of the frame 100. In the arrangement illustrated, magnets 122 are located in each corner in recesses 124 in the back panel 120. In another arrangement, more than one magnet may be secured in around each corner. In other arrangements, magnets may also or instead be secured to other locations on the top, bottom, and sides of the back panel 120. One or more magnet cover plates 126, which may be made from plastic, may be used to cover the magnets 122 and help hold them in place. FIG. 4 illustrates two strips used as covers 126. Other configurations may also be used, including one cover in each of the four corners. An optional hinged leg 128 (shown in FIG. 2B but not in FIG. 4) may be secured to the back of the back panel 120 to allow the frame 100 to be used on a table or other horizontal surface. The leg 128 may be secured to the back of the back panel with a hinge pin 128A though openings 128B in the panel 120 (see FIG. 5). Preferably, the hinged leg 128 has a thickness so that it does not extend beyond the outside of the magnets 122, allowing the frame 100 to rest flat against a wall.

Figure 5:
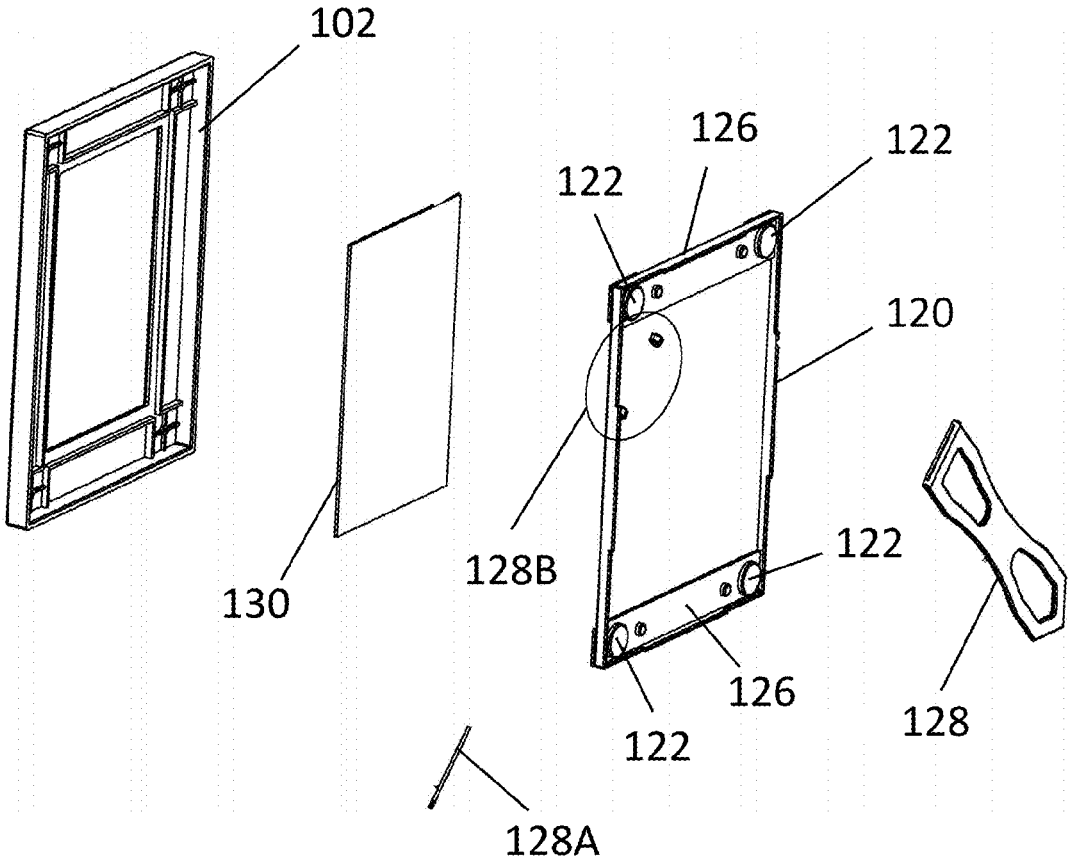
FIG. 5 is an exploded rear view of the display frame of FIG. 2A.
Figure 6:
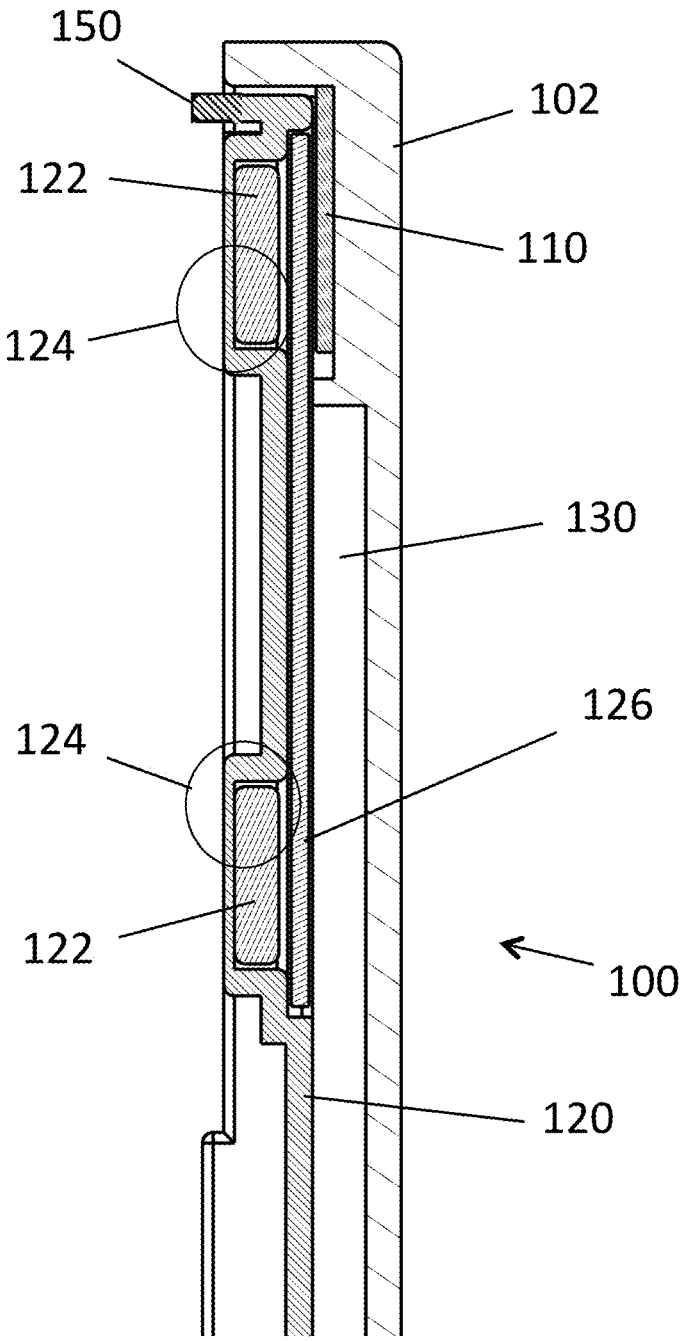
FIG. 6 is a cross-sectional view of the top portion of the display frame of FIG. 1.

Turning to FIG. 5, the exploded rear view of the frame 100 illustrates the manner in which the components of the frame 100 are assembled. The magnets 122 are inserted into the recesses 124 in the front of the back panel 120 and the covers 126 secured over the magnets 122. The metal plates 110 (not shown in FIG. 5) are secured to the back of the front panel 102 and the front panel 102 placed over the transparent sheet 130. The transparent sheet 130, which may be plastic, glass, or other clear material, is placed onto the back of the front panel 120. In use, a picture or other sheet to be displayed, is placed between the back panel 120 and the transparent sheet 130. The front and back panels 102, 120 are held together by the magnets 122 and plates 110 to form the display frame 100. FIG. 6 is a cross-sectional view of the top portion of the frame 100 with a picture in place. As can be seen in FIG. 6, the front panel 102 may be dimensioned and shaped so as to cover and hide the outer edges of the back panel 120.

Figure 7:
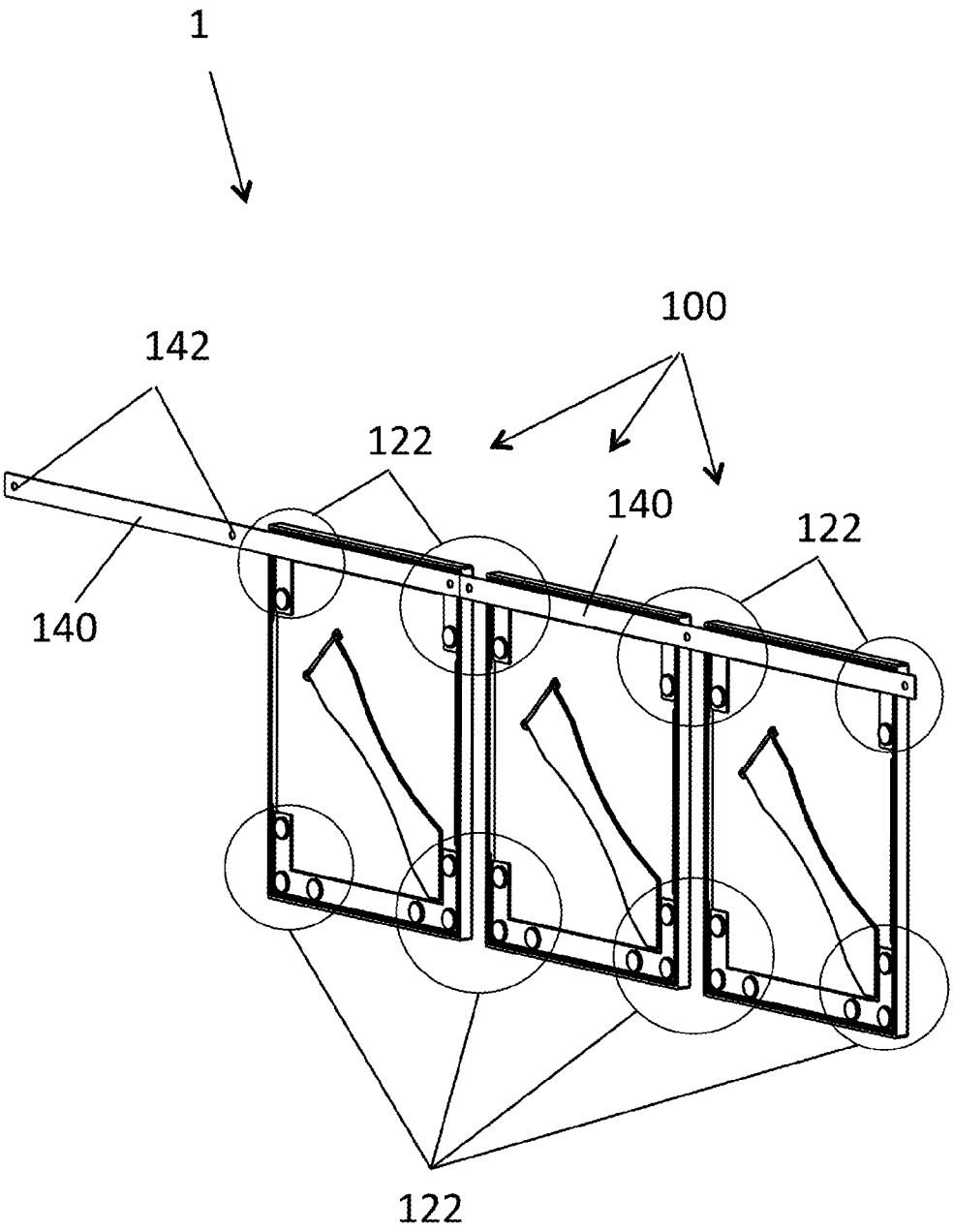
FIG. 7 illustrates a back view of an embodiment of the picture display system of the present invention.
Figure 8:
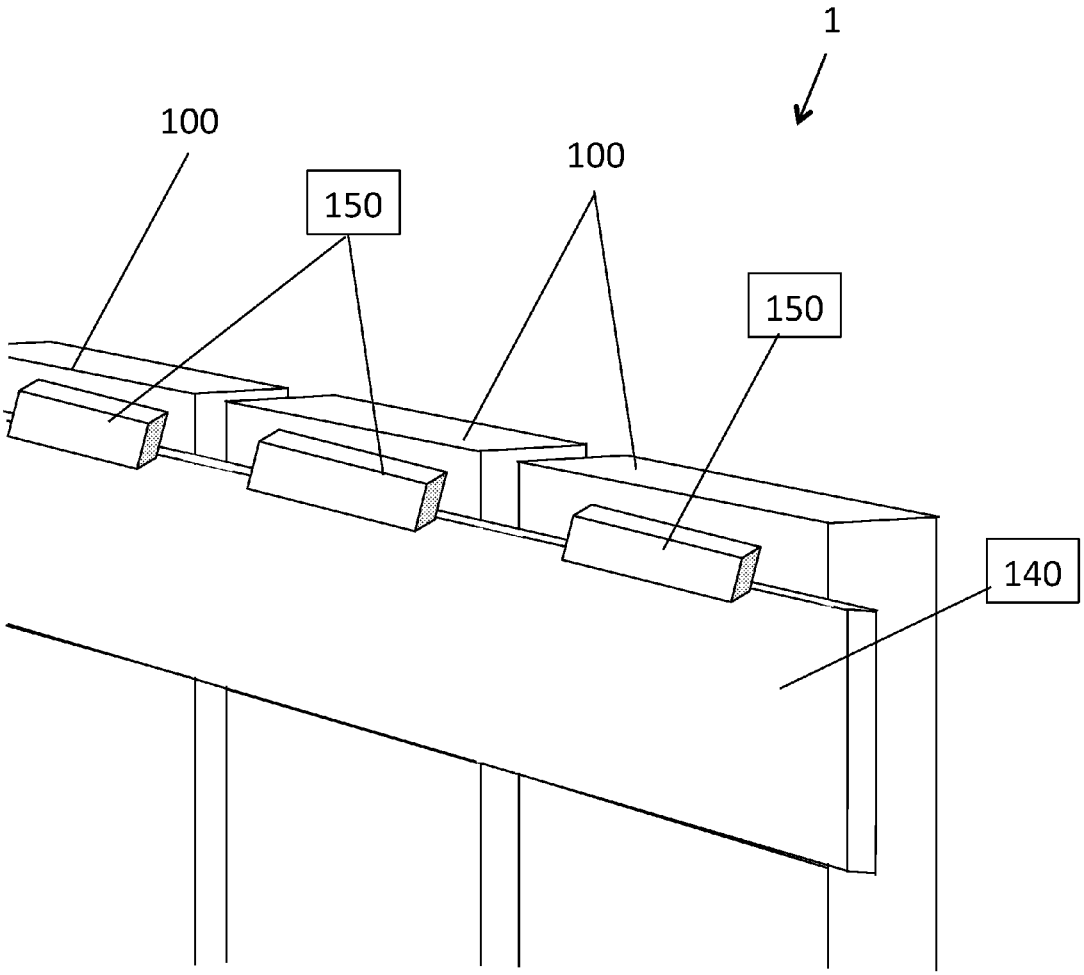
FIG. 8 is a close-up view of the back of a portion of the picture display system of the present invention.

FIG. 7 illustrates a back view of an embodiment of the picture display system 1 of the present invention with three display frames 100 magnetically secured to a ferrous strip 140, which may be secured to a wall or other surface using adhesive or fasteners, such as hooks, screws, or nails, through spaced apart holes 142. FIG. 7 illustrates two abutting ferrous strips 140; however, a single strip or more than two strips of appropriate length(s) may be used to hold the any number of frames 100 in place. For additional security, one or more lower strips may be used to hold the bottoms of the frames 100. FIG. 8 is a close-up view of the back of a portion of the picture display system 1 of the present invention. An optional horizontal rib 150 on the back of each frame 100 (see also FIG. 6) aids in aligning each frame 100 with the ferrous strip 140. The ribs 150 rest against the top edge of the strip 140 to also help support the frames 100 on the strip 140 and reduce the risk of a frame 100 slipping downward.

It will be appreciated that the display frames 100 may be manufactured with a variety of dimensions to accommodate conventional size pictures and paper, such as 3"×5", 4"×6", 5"×7", 8"×10", 8½"×11", or larger to accommodate posters, large prints, wall art, and among others. The frames 100 may also be dimensioned to accommodate matting. In one embodiment, the front panel 102 is 12.15 inches by 10.15 inches and has an opening 104 of 9.75 inches by 7.75 inches to accommodate an 8"×10" photo or a 5"×7" matted photo. In one embodiment, the magnets 122 may be neodymium magnets approximately 0.5 inches in diameter and approximately 0.125 inches thick. More than the four magnets 122 may be used for larger or heavier frames 100. The ferrous strips 140 may also be sold in any length, such as one, two, three, or four feet with an appropriate number of spaced apart holes 142. It will also be appreciated that any frame 100 may be placed on the ferrous strip 140 in either the horizontal or vertical positions. The frames 100 may be made of any appropriate material, including wood, plastic, metal, and leather- or cloth-covered, may be painted or otherwise colored, and may be manufactured in various styles to appeal to a broad range of consumers.

In use, a consumer may separate the front panel 102 of a frame 100 from the back panel 120 and insert photos, cards, children's drawings, award certificates, or any other items of interest behind the transparent sheet 130. The front panel 102 may then be placed onto the back panel 120 and held securely by the magnetic cooperation of the magnets 122 with the metal plates 110. The consumer may mount one or more ferrous strips 140 to a wall, cabinet, or other vertical surface. The frame 100 and other frames on are easily arranged and hung on the ferrous strip(s) 140, to be held in place by the magnetic cooperation between the magnets 122 and the ferrous strip 140. Referring back to FIG. 1, one possible arrangement is illustrated of frames with the modular picture display system 1 of the present invention. By choosing an appropriate color and style of the frames 100, the consumer can easily fit the modular picture display system 1 of the present invention to the decor of any room. Further, the color and style of a frame 100 can easily be changed by separating the front panel 102 from the back panel 120 and replacing it with a different front panel. Thus, the modular picture display system 1 is adaptable if the consumer's tastes change, if the consumer wants to move the pictures to a different room, or if the consumer wants to insert a different picture in the frame 100. The display system 1 may also be used in non-consumer settings, such as to display restaurant menus, employee award certificates, student's work in classrooms, and real estate open house displays, among others.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A modular picture display system, comprising:

a display frame, comprising:

a back panel;

a plurality of spaced apart magnets secured to a front-side of the back panel;

a front panel having a central opening and edging surrounding the opening, the front panel configured to fit over the back panel; and a plurality of spaced apart ferrous plates secured to the backside of the front panel, whereby the backside of the front panel is securable to the front-side of the back panel through magnetic cooperation between the ferrous plates and the plurality of magnets; and a ferrous strip, mountable on a vertical surface, on which the display frame is held in place in magnetic cooperation with the plurality of magnets; wherein the plurality of magnetic members are in magnetic cooperation with the plurality of ferrous plates and the ferrous strip.

2. The modular picture display system of claim 1, further comprising a horizontal rib secured to a back-side of the back panel configured to rest against a top edge of the ferrous strip.

3. The modular picture display system of claim 1, wherein ferrous plates are secured in recesses in the backside of the front panel.

4. The modular picture display system of claim 1, wherein plurality of magnets are secured in recesses in the front-side of the back panel.

5. A method for providing a picture display system, comprising:

providing a back panel;

securing a plurality of spaced apart magnets to a front-side of the back panel;

providing a front panel having a central opening and being configured to fit over the back panel;

securing a plurality of spaced apart ferrous plates to a backside of the front panel;

securing the backside of the front panel to the front-side of the back panel through magnetic cooperation between the ferrous plates and the plurality of magnets to form a display frame; and providing a ferrous strip, mountable on a vertical surface, on which one or more display frames are held in place in magnetic cooperation with the plurality of magnets;

wherein the plurality of magnetic members are in magnetic cooperation with the plurality of ferrous plates and the ferrous strip.

6. The method of claim 5, further comprising securing a horizontal rib to a back-side of the back panel configured to rest against a top edge of the ferrous strip.

7. The method of claim 5, further comprising securing the ferrous plates in recesses in the backside of the front panel.

8. The method of claim 5, further comprising securing the plurality of magnets in recesses in the front-side of the back panel.

* * * * *